US005476236A

United States Patent [19]

Schneider et al.

[11] Patent Number: 5,476,236

[45] Date of Patent: Dec. 19, 1995

[54] HUB FOR HOLDING TAPE IN A WOUND CONFIGURATION

[75] Inventors: Ron Schneider, Imperial Beach; Frederick G. Budde, Jr., El Cajon, both of Calif.; Jose C. Figueroa, Tijuana, Mexico

[73] Assignee: Cintas Technologies, Inc., Chula Vista, Calif.

[21] Appl. No.: 122,018

[22] Filed: Sep. 15, 1993

[51] Int. Cl.[6] ..... B65H 75/10

[52] U.S. Cl. ..... 242/605; 242/611.2

[58] Field of Search ..... 242/605, 611.2, 242/118.41; 206/389, 391, 394, 503, 509

[56] References Cited

U.S. PATENT DOCUMENTS

| | | | |
|---|---|---|---|
| 4,081,151 | 3/1978 | Ender | 242/605 |
| 4,280,670 | 7/1981 | Schor | 242/605 |
| 4,340,188 | 7/1982 | Derendorf | 242/605 |
| 4,341,357 | 7/1982 | Filippo | 242/605 |
| 5,169,086 | 12/1992 | Vesely | 242/605 X |

*Primary Examiner*—John M. Jillions
*Attorney, Agent, or Firm*—Ellsworth R. Roston; Charles H. Schwartz

[57] ABSTRACT

A peripheral portion in a hub is hollow, flat and defined by a pair of spaced and parallel surfaces. An annular periphery in this portion holds a tape in a wound configuration. An additional portion integral with the inner periphery of the peripheral portion has undulations each disposed radially. The undulations extend progressively in an annular direction. Preferably the undulations are in the form of corrugations each having oppositely disposed segments. Preferably each corrugation segment has the same angle as the other segment in such corrugation, this angle preferably being approximately 47°. Preferably the additional portion has first and second surfaces shaped to define the corrugations. Preferably the first surface of the additional portion is alternately substantially flush with one flat surface of the peripheral portion and then is spaced outwardly in a first axial direction from the other flat surface of the peripheral portion. Preferably the second surface of the additional portion is alternately substantially flush with the other flat surface of the peripheral portion and then is spaced outwardly in an opposite axial direction from the one flat surface of the peripheral portion. Preferably the extremity of each corrugation is flat and substantially parallel to the flat surfaces of the peripheral portion. The additional portion is hollow at its radial interior. Recesses extend radially into the additional portion from the hollow interior at spaced annular intervals to receive pins in a driving member. The hubs thus nest when stacked and occupy a minimal space.

5 Claims, 1 Drawing Sheet

HUB FOR HOLDING TAPE IN A WOUND CONFIGURATION

This invention relates to a hub for holding a tape in a wound configuration on its external periphery. More particularly, the invention relates to a hub which is relatively simple in construction and yet is stronger than the hubs of the prior art and which nests in a stacked relation with other hubs of the same construction.

Magnetic tapes are used extensively to store and reproduce magnetically recorded audio information. For example, most automobiles have a reproducer for playing back music or lectures recorded on tape. While the passengers in the automobile travel between one destination and another, such as between the home and the office, the passengers can accordingly be entertained or educated.

The magnetic tapes are generally wound on an annular peripheral surface of a hub which may be constructed in a hollow disc-shaped form. The hub is generally provided with a winding surface at its outer radial end to hold the tape in a wound configuration on its external annular periphery. The hub is generally provided with a configuration radially interior to the winding surface such that the hubs will nest when stacked. In this way, the hubs can be disposed in a minimal space when stacked and can be shipped in this nested relationship from the manufacturer to the customer. The hubs can be shipped either with or without a tape wound on the hub.

Various types of hubs providing a nesting relationship, when stacked, have been produced in the prior art. However, these hubs have had certain disadvantages. One disadvantage is that the hubs have been relatively complicated in construction. Another disadvantage has been that a relatively low force inadvertently applied to the hubs in a radial direction from a position external to the periphery of the hubs has tended to separate the hubs from a nested relationship when the hubs have been stacked in the nested relationship. A further disadvantage has been that the hubs tend to buckle from the radial force produced on the peripheries of the hubs by the tension of the tapes wound on the hubs, particularly since these tapes may be as long as approximately three (3) miles if extended in an unwound configuration.

This invention provides a hub which overcomes the disadvantages specified above. The hub of this invention is relatively simple in construction. It can be made from a minimum amount of material to minimize costs. It can be produced relatively efficiently and inexpensively. It does not become unstacked easily from a nested relationship even when subjected inadvertently to a radial force from a position external to the hub. It is able to withstand the tension of the tape on the hub without buckling even when the tape has an unwound length as long as approximately three (3) miles.

In one embodiment of the invention, a peripheral portion in a hub is hollow, flat and defined by a pair of spaced and parallel surfaces. An annular periphery in this portion holds a tape in a wound configuration. An additional portion is integral with the inner periphery of the peripheral portion. The additional portion has undulations each disposed radially. The undulations extend progressively in an annular direction. Preferably the undulations are in the form of corrugations each having oppositely disposed segments. Preferably each segment in each corrugation has the same angle as the other segment in such corrugation, this angle preferably being 47°.

Preferably the additional portion has first and second surfaces shaped to define the corrugations. Preferably the first surface of the additional portion is alternately substantially flush with one flat surface of the peripheral portion and then is spaced outwardly in a first axial direction from the other flat surface of the peripheral portion. Preferably, the second surface of the additional portion is alternately substantially flush with the other flat surface of the peripheral portion and then is spaced outwardly in an opposite axial direction from the one flat surface of the peripheral portion.

Preferably the extremity of each corrugation is flat and substantially parallel to the flat surfaces of the peripheral portion. The additional portion is hollow at its radial interior. Recesses extend radially into the additional portion from the hollow interior at spaced annular intervals to receive pins in a driving member. The hubs thus nest when stacked and occupy a minimal space.

In one embodiment of the invention, a hub generally indicated at 10 may be provided. The hub 10 may be made from a suitable material such as a thermosetting plastic preferably having electrically insulating properties. The hub 10 includes a peripheral portion 12 having a flat pancake configuration with a pair of spaced flat and parallel surfaces 14 and 16. The distance between the surfaces 14 and 16 may be a value which equals the product width to be wound on the hub, such as approximately one hundred and fifty thousands of an inch (0.150").

Figure 6:
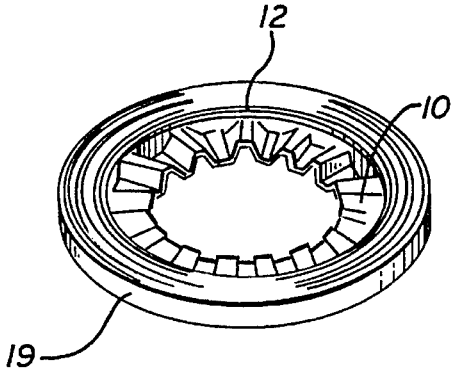
FIG. 6 is a perspective view of the hub and schematically illustrates a tape wound on the hub.

The peripheral portion 12 has an outer peripheral surface 18 which may have an annular configuration. The radial distance between the outer peripheral surface 18 and the inner diameter of the peripheral portion 12 may be approximately one tenth of an inch (0.1"). The outer diameter of the peripheral portion 12 may be approximately four and one half inches (4.5"). A tape 19 (FIG. 6) may be wound on the annular peripheral surface 18 of the peripheral portion 12. As the word "tape" is used in the specification and the claims, it is intended to include any strip or ribbon.

An additional portion 20 may be integral at its radially outer end with the radially inner end of the peripheral portion 12. The additional portion 20 may be formed from a plurality of undulations generally indicated at 22. Each of the undulations 22 may be defined by a pair of segments 24 and 26 each of which has a suitable angle such as approximately 47° with the flat surfaces 14 and 16. Preferably, fifteen (15) undulations 22 extend around the annular periphery of the peripheral portion 12. A surface such as that indicated at 28 extends radially inwardly from the inner surface of the peripheral portion 12 at a suitable angle such as approximately 45° and joins the segments 24 and 26 of each undulation.

Preferably, the undulations 22 are in the form of corrugations in which each of the corrugations is defined by the segments 24 and 26. The corrugations have first and second surfaces 30 and 32 which are separated from each other by a suitable thickness such as approximately one tenth of an inch (0.100"). In defining the corrugations, the surface 30 is alternately substantially flush with the surface 14 and is then spaced axially outwardly from the surface 16 by a distance of approximately one tenth of an inch (0.1") corresponding to the thickness of the corrugations. In like manner, the surface 32 is alternately substantially flush with the surface 16 and is then spaced axially outwardly from the surface 14, in a direction opposite to the direction of the surface 30, by the distance of approximately one tenth of an inch (0.1"). In this way, the total axial thickness of the hub 10 may be approximately three hundred and fifty thousandths of an inch (0.350").

The surfaces 30 and 32 are flattened in a radial direction at their axial extremities as respectively indicated at 40 and 42. The width of each of these flattened surfaces 40 and 42 may be approximately 0.1366". The flattened surfaces 40 and 42 may be substantially parallel to the surfaces 14 and 16 of the peripheral portion 12. By flattening the corrugations to provide the flattened surfaces 40 and 42, the axial width of the hub 10 may be significantly decreased and the nesting of the hubs 10 in the stacked relationship may be facilitated.

The additional portion 20 may be hollow at its center as indicated at 44. The diameter of the hollow periphery of the additional portion 20 may be approximately three inches (3.0"). Recesses 46 may be provided at equally spaced annular distances around the hollow inner periphery 44 of the additional portion 20. For example, six recesses 46 may be formed at equally spaced annular distances around the inner periphery 44 of the additional portion 40. Each of the recesses 46 may be provided with a suitable diameter such as approximately 0.234". Alternate ones of the recesses 46 may be formed at the flattened surfaces 40 and the other ones of the recesses 46 may be formed at the flattened surfaces 42. Pins or keys of a driving member (not shown) may be disposed in the recesses 46 to hold the hub 12 in a locked relationship with the winding member during the winding of the product.

Figure 1:
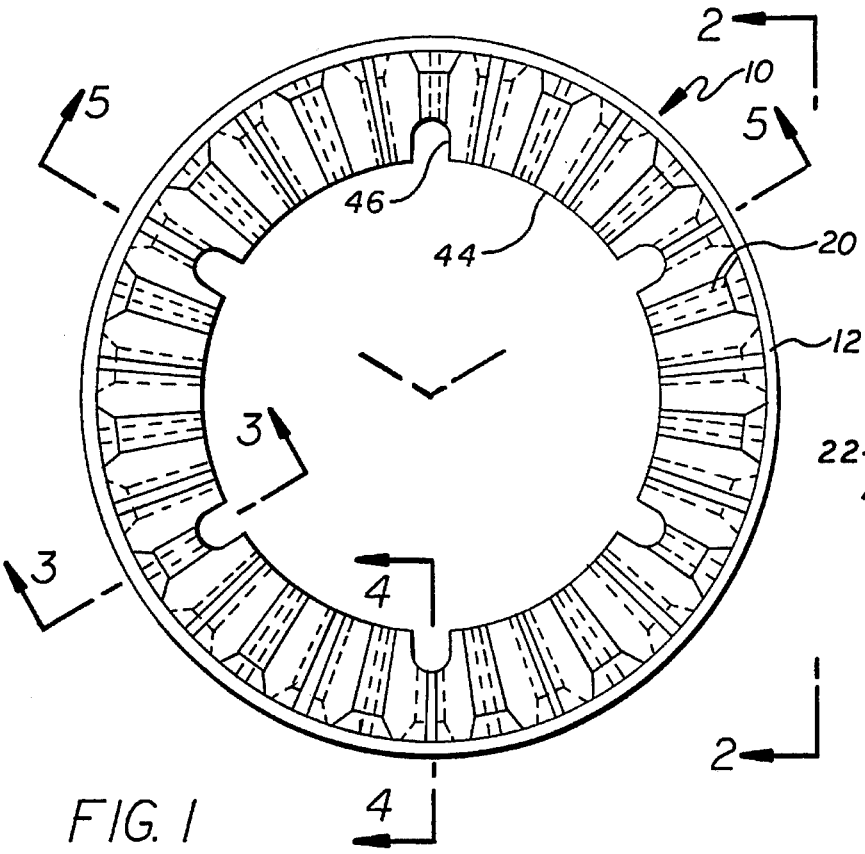
FIG. 1 is a plan view of a hub constituting one embodiment of the invention.
Figure 2:
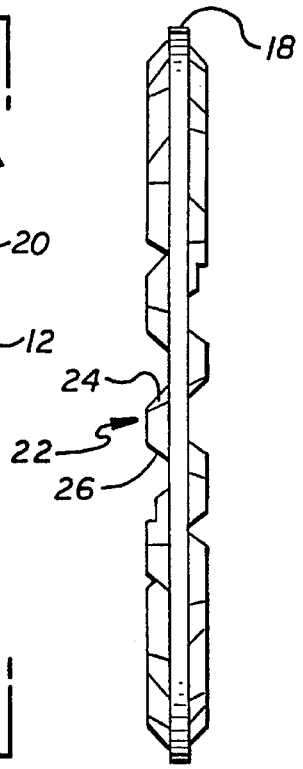
FIG. 2 is a sectional view of the hub shown in FIG. 1 and is taken substantially on the line 2—2 of FIG. 1.
Figure 3:
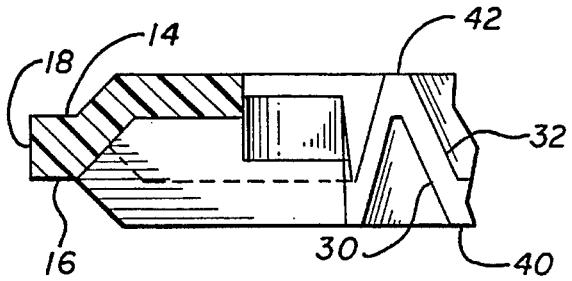
FIG. 3 is an enlarged fragmentary sectional view of the hub and is taken substantially on the line 3—3 of FIG. 1.
Figure 4:
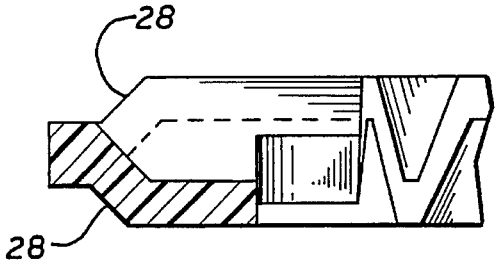
FIG. 4 is an enlarged fragmentary sectional view of the hub and is taken substantially on the line 4—4 of FIG. 1.
Figure 5:
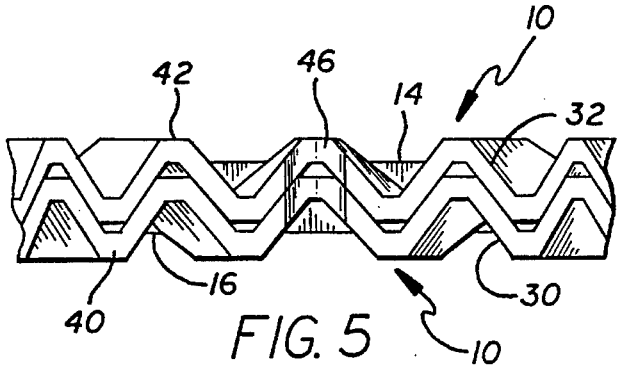
FIG. 5 is an enlarged fragmentary sectional view of a plurality of the hubs in a stacked, or nested, relationship and is taken substantially on the line 5—5 of FIG. 1.

FIG. 5 illustrates how the hubs 10 may be stacked in a nested relationship. As shown, the segments 24 and 26 in each hub 10 nest inside the cavity defined by the segments 24 and 26 of the contiguous hub. This minimizes the space occupied by the hubs when the hubs are stacked in the nested relationship. In this nested relationship, the hubs are able to withstand forces inadvertently exerted on the hubs in a direction (e.g. radial) to separate the hubs from the nested relationship. Furthermore, the hubs are able to withstand the force exerted by the tape on the hubs in the radial direction after the hubs have been individually removed from the nested relationship and the tapes have been wound on the hubs. This is true even when the tapes have an unwound length of approximately one (1) mile.

As previously indicated, the peripheral portion 12 has a radial dimension which is relatively short compared to the radial dimension of the additional portion 20. This enhances the ability of the hub 10 to withstand the force exerted by the tape on the hub in the radial direction after the hub has been removed from the nested relationship and the tape has been wound on the hub. It also enhances the ability of the hubs to remain stacked in the nested relationship.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. A hub for holding a tape in a wound configuration, including, a hollow annular portion having an inner annular periphery and annular outer periphery for receiving the tape in the wound configuration on such outer annular periphery and having a pair of flat parallel surfaces extending radially inwardly from the outer annular periphery in spaced relationship to each other, and an additional portion extending radially inwardly from the inner annular periphery of the annular portion and extending in an annular direction alternately axially toward one of the flat surfaces on the hollow annular portion and then axially toward the other flat surface on the flat annular portion, the hollow annular portion and the additional portion being integral, the additional portion being hollow, the alternate axial extensions in the annular direction being defined by first and second surfaces separated from each other in the axial direction with the first one of the surfaces alternately extending at progressive positions in the annular direction to an axial position substantially flush with one of the flat parallel surfaces of the hollow annular portion and then to an axial position beyond the other parallel surface of the hollow annular portion and the second one of the surfaces alternately extending at progressive positions in the annular direction to an axial position beyond the one parallel surface of the hollow annular portion and then to an axial position substantially flush with the other parallel surface of the hollow annular portion.

2. A hub as set forth in claim 1, including, each of the first and second surfaces in the alternate extensions axially at the progressive positions in the annular direction having a flat portion at the positions axially beyond the flat parallel surfaces of the hollow annular portion.

3. A hub as set forth in claim 2, including, the additional portion having an annular peripheral surface defining a hollow interior in the additional portion, and there being recesses in the additional portion at spaced annular positions around the annular peripheral surface defining the hollow interior of the additional portion.

4. A hub as set forth in claim 3, including, the first peripheral portion and the additional portion being integral.

5. A hub as set forth in claim 1, including, a tape wound on the outer annular periphery of the hollow annular portion.

* * * * *